US010377454B2

(12) United States Patent
Surges

(10) Patent No.: US 10,377,454 B2
(45) Date of Patent: Aug. 13, 2019

(54) WATERCRAFT LIFT

(71) Applicant: Carl Surges, St. Germain, WI (US)

(72) Inventor: Carl Surges, St. Germain, WI (US)

(73) Assignee: Pier of D' Nort Corp., St. Germain, WI (US)

( * ) Notice: Subject to any disclaimer, the term of this patent is extended or adjusted under 35 U.S.C. 154(b) by 0 days.

(21) Appl. No.: 15/297,985

(22) Filed: Oct. 19, 2016

(65) Prior Publication Data

US 2018/0105237 A1 Apr. 19, 2018

(51) Int. Cl.
*B63C 3/06* (2006.01)
*B63C 3/12* (2006.01)

(52) U.S. Cl.
CPC . *B63C 3/06* (2013.01); *B63C 3/12* (2013.01)

(58) Field of Classification Search
CPC .... B63C 3/06; B63C 3/00; B63C 3/12; B63C 15/00; B63C 3/04; B63B 2035/715; B63B 23/04; B63B 23/18; B63B 23/32; B63B 27/16
USPC ..... 405/1, 3, 7
See application file for complete search history.

(56) References Cited

U.S. PATENT DOCUMENTS 2,815,131 A * 12/1957 Lunsman ..... B63B 23/06 114/373
3,087,628 A * 4/1963 Jester ..... B63C 3/06 414/678
3,401,806 A * 9/1968 Schmit ..... B63C 3/06 114/366
4,763,593 A * 8/1988 Lasko ..... B63C 3/04 114/373
4,787,327 A 11/1988 Porter
4,864,951 A * 9/1989 Koepp, Jr. ..... B63B 23/32 114/366
4,964,358 A * 10/1990 Sandrow ..... B63B 23/32 114/365
5,090,842 A * 2/1992 Montgomery ..... B63C 3/06 114/44
5,133,275 A * 7/1992 Maurizio ..... B63B 23/32 114/259
5,193,479 A * 3/1993 Bielefeld ..... B63B 23/32 114/259
6,474,256 B1 11/2002 Vogel
7,293,521 B1 * 11/2007 Johns, Jr. ..... B63B 27/16 114/259
9,145,189 B2 9/2015 Johansson
9,527,562 B1 * 12/2016 Sterling ..... B63C 15/00
2007/0041788 A1 2/2007 Stewart
(Continued)

OTHER PUBLICATIONS

Patent Cooperation Treaty International Searching Authority, The International Search Report and Written Opinion for application No. PCT/US2017/057379, dated Dec. 26, 2017, 15 pages.

*Primary Examiner* — Carib A Oquendo
(74) *Attorney, Agent, or Firm* — Merchant & Gould P.C.

(57) ABSTRACT

A watercraft lift includes a base that is configured to be attached to a fixed surface. The watercraft lift includes an extension that extends from the base. The extension includes a pair of arms and a pair of legs. Each leg is attached to, and extends away from, each arm. The extension is rotatable about the base between a lowered position and a raised position. Then in the lowered position, the extension is configured to receive a watercraft, and when in the raised positioned, the extension is configured to store the watercraft.

19 Claims, 15 Drawing Sheets

(56) References Cited

U.S. PATENT DOCUMENTS

| | | | | |
|---|---|---|---|---|
| 2008/0105186 | A1 | 5/2008 | Johns et al. | |
| 2011/0188931 | A1* | 8/2011 | Wrobbel | B63C 3/00 405/1 |
| 2015/0266550 | A1* | 9/2015 | Isbill | B63B 23/02 114/373 |
| 2016/0083059 | A1* | 3/2016 | Kroeger | B63C 3/12 405/3 |

* cited by examiner

WATERCRAFT LIFT

BACKGROUND

Small watercraft (for example: canoes, kayaks, stand up paddleboards, and the like) are often used on waterways (streams, rivers, lakes, oceans) as a form of recreation and transportation. When not being used, small watercrafts are often stored out of the water due to their relatively small size with respect to full size boats and tendency to be easily jostled when in the water when not manned. However, many small watercrafts are large and heavy enough to be cumbersome and difficult to remove from the water by a single operator.

Docks can be configured to be a floating structure over water or a raised platform over the surface of the water (also known as a pier). Docks can provide a convenient storage solution for small watercraft. However, docks are commonly raised above the water, therefore forcing the operator to lift the small watercraft from the water and occupy otherwise usable square footage on the dock deck with the stored watercraft. Further, inverting the small watercraft so as to prevent rain water from collecting in the watercraft is often preferred. Many small watercrafts are both cumbersome to invert and difficult to secure for storage when inverted.

Therefore, improvements in watercraft storage are needed.

SUMMARY

The present disclosure relates generally to watercraft lift. In one possible configuration, and by non-limiting example, the watercraft lift includes a pivotable pair of supports that are configured to raise a watercraft from the water and securely store the watercraft in raised position.

In one aspect of the present disclosure, a watercraft lift is disclosed. The watercraft lift includes a base that is configured to be attached to a fixed surface. The watercraft lift includes an extension that extends from the base. The extension includes a pair of arms and a pair of legs. Each leg is attached to, and extends away from, each arm. The extension is rotatable about the base between a lowered position and a raised position. Then in the lowered position, the extension is configured to receive a watercraft, and when in the raised positioned, the extension is configured to store the watercraft.

In another aspect of the present disclosure, a watercraft lift is disclosed. The watercraft lift includes a base that is configured to be attached to a fixed surface. The base includes a pair of support legs. The watercraft lift includes an extension that includes a first support that extends from the base and a second support that extends from the base. The watercraft lift includes an extension actuator that is in communication with the first support. The extension actuator is configured to move the first support between a lowered position and a raised position. The watercraft lift includes a linkage attached to the first support and the second support. The linkage is configured to move a second support between a lowered position and a raised position in unison with the first support when the extension actuator moves the first support between the lowered position and the raised position.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
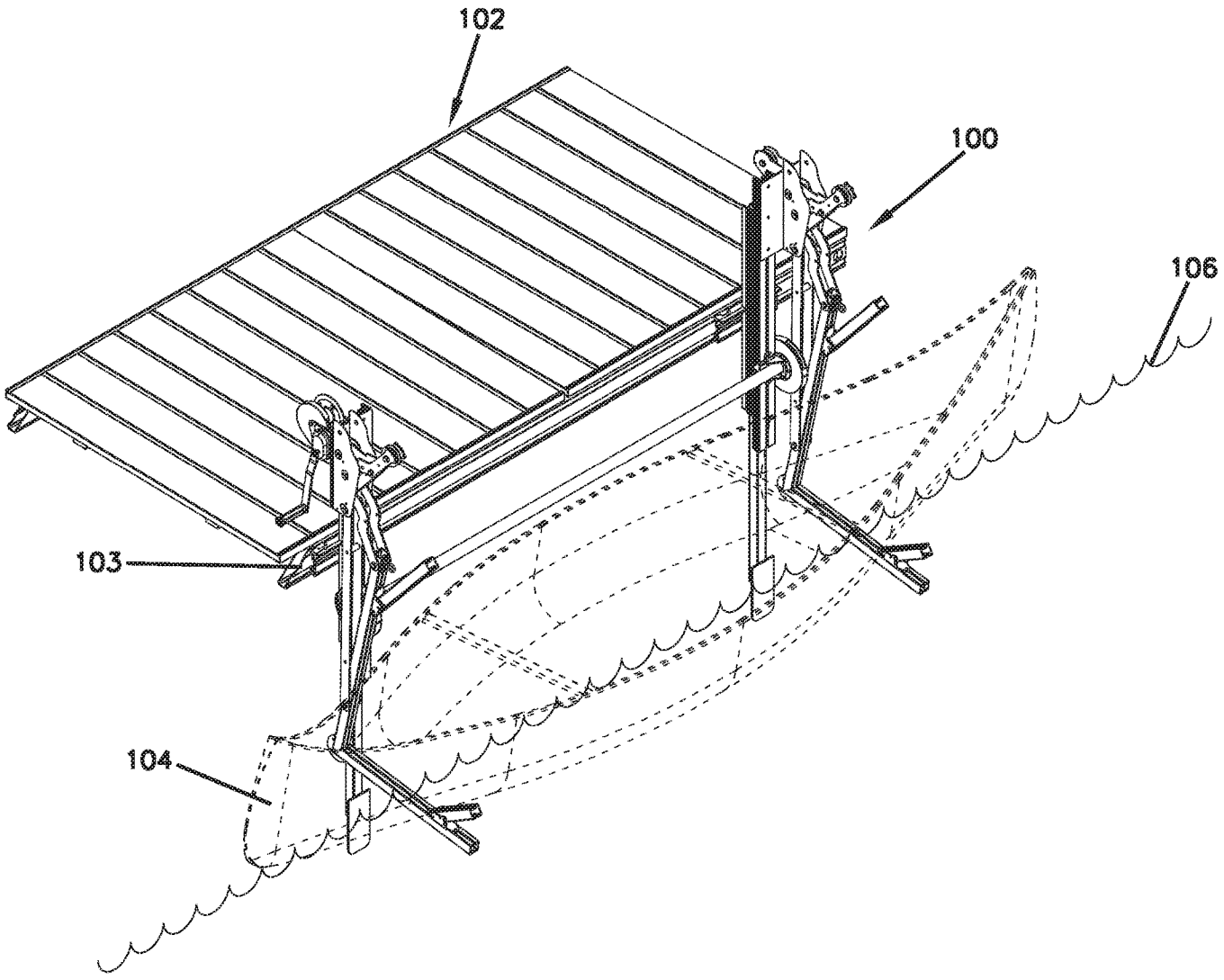
FIG. 1 illustrates a perspective view of a watercraft lift in a lowered position holding a watercraft, according to one embodiment of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

The watercraft lift disclosed herein has several advantages. The watercraft lift allows the user a convenient and secure storage solution for small watercraft. Further, the watercraft lift is configured to pivot the watercraft from the water while simultaneously inverting watercraft for storage.

The watercraft lift is further designed to require minimal exertion to operate by the watercraft operator.

Figure 2:
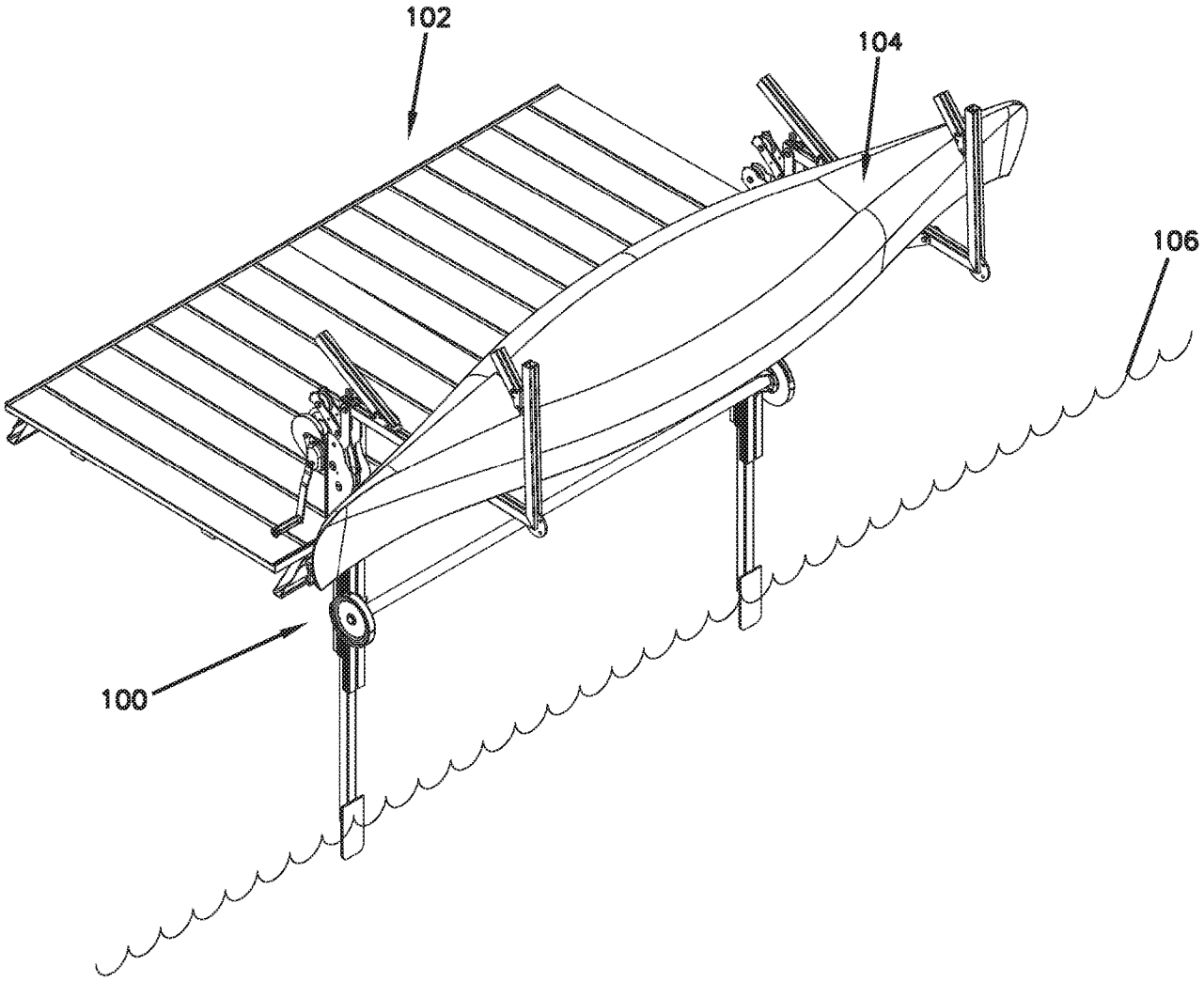
FIG. 2 illustrates a perspective view of the watercraft lift of FIG. 1 in the raised position storing a watercraft.

A watercraft lift 100 is shown in FIG. 1 attached to a structure 102. The watercraft lift 100 is shown in FIG. 1 in a lowered position while holding a watercraft 104 in water 106. In FIG. 2, the watercraft lift 100 is shown in a raised position so as to store the watercraft 104 in an inverted, or upside down, orientation above the water 106.

The watercraft lift 100 is configured to receive the watercraft 104 in the water 106, raise the watercraft 104 from the water 106, and store the watercraft 104 above the water 106 in the raised position (as shown in FIG. 2). The watercraft lift 100 will be described in more detail with respect to FIGS. 3-12.

The structure 102 can be a variety of different structures capable of receiving the watercraft lift 100. In the depicted embodiment, and for illustrative purposes, the structure 102 is a portion of a dock. The portion of the dock can be a portion of a floating dock or of a raised dock (i.e., a pier). An example dock system is disclosed in U.S. Pat. No. 7,241,078, which is incorporated herein in its entirely by reference. In some embodiments, the structure 102 includes a channel 103 that is configured to receive at least a portion of the watercraft lift 100. The structure 102 is configured to allow an operator of the watercraft lift 100 to access the watercraft lift 100 for operation.

The watercraft 104 shown is a canoe; however, other small watercrafts can be used with the watercraft lift 100. For example, kayaks, stand up paddleboards, and other small boats can also be used with the watercraft lift 100.

Figure 3:
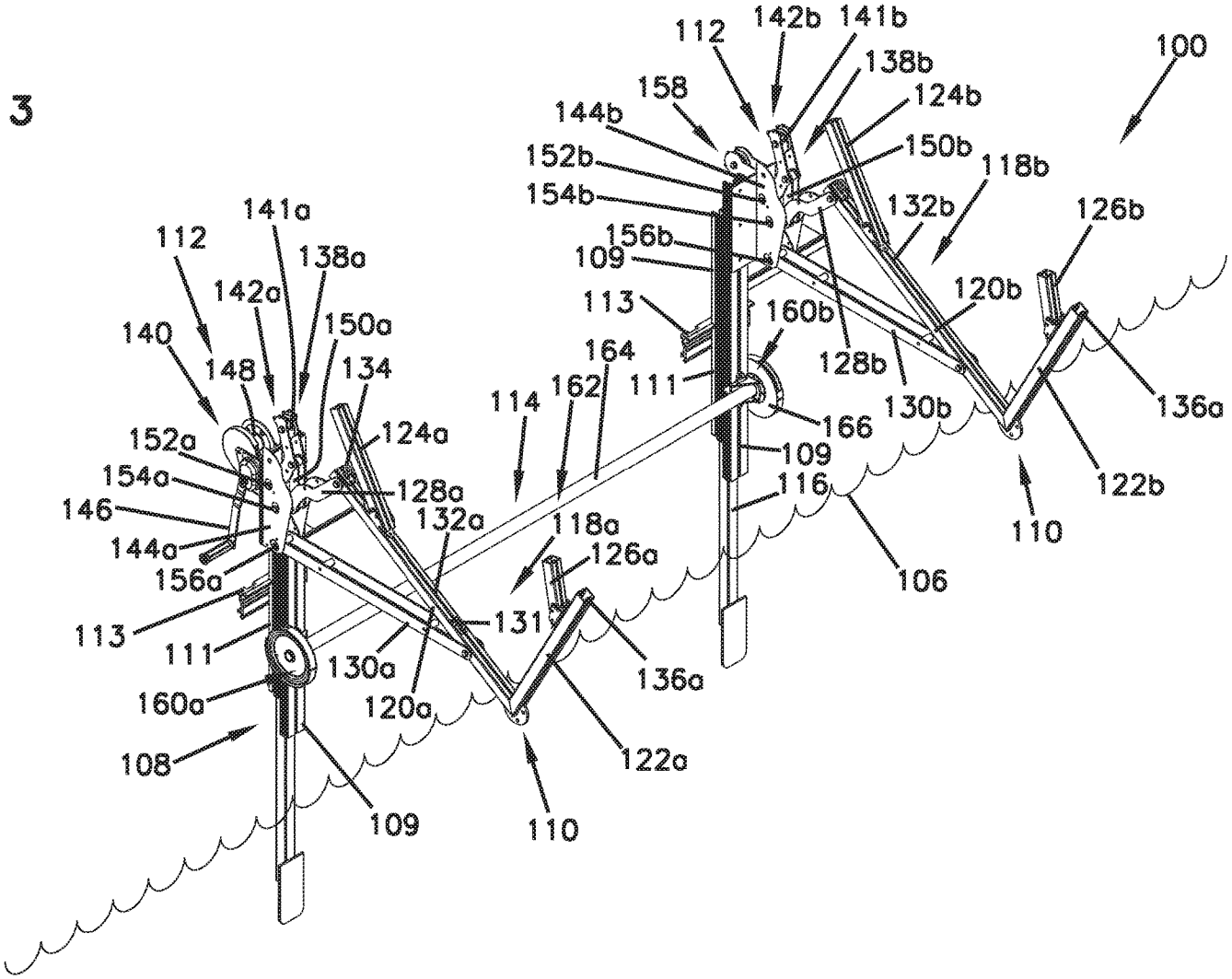
FIG. 3 illustrates a perspective view of the watercraft lift of FIG. 1 between the raised position and the lowered position.

FIG. 3 shows a perspective view of the watercraft lift 100 in a position between the lowered position and the raised position. The watercraft lift 100 is shown without the watercraft 104 and not connected to the structure 102. The watercraft lift 100 includes a base 108, an extension 110 pivotally attached to the base 108, a pivoting assembly 112, and a linkage 114.

The base 108 of the watercraft lift 100 is configured to attach to the structure 102 so as to fix the watercraft lift 100 in a stable position. The base 108 includes a pair of first base members 109 and second base members 111 that are fixed to the structure 102 by way of mounting features 113. Further, in some embodiments, the second base members 111 include support legs 116 that extend therefrom.

The first base members 109 are rigid elongate members configured to be slidably mounted to the second base members 111 which are mounted to the structure 102. Further, the first base members 109 provide a stable mounting location for the extension 110, the pivoting assembly 112, and the linkage 114, all of which will be discussed further herein. The first base members 109 are adjustable along the length of the of the second base members 111 so as to allow the base 108 to be adjustable in the vertical direction.

The mounting features 113 are connected to each second base members 111 of the base 108 and are configured to securely mount the second base members 111 to the structure 102. In some embodiments, the mounting features 113 can be configured to mount within the channel 103. In other embodiments, the mounting features 113 can be configured to mount within the channel 103 using a dovetail clamp. In other embodiments still, the mounting features are configured to clamp to the structure 102. In still other embodiments, the mounting features 113 are a plurality of fasteners. The mounting features 113 can be configured to be removable so that the watercraft lift 100 can be removed from the structure 102 and mounted to a different structure.

The support legs 116 are configured to aid in supporting the watercraft lift 100. In some embodiments, the watercraft lift 100 can include a pair of support legs 116. The support legs 116 are configured to rest on a water floor (not shown) (e.g., lake bottom) of the water 106. In some embodiments, the support legs 116 can be extendable. In some embodiments, the legs 116 can be adjustable so as to adapt to a variety of different floor surfaces and to accommodate different depths of water. In some embodiments, the legs 116 are configured to penetrate the water floor so as to further support the watercraft lift.

The extension 110 of the watercraft lift 100 is configured to pivotally attach to the pivoting assembly 112, which is mounted to the base 108. The extension 110 includes a first watercraft support 118*a* and a second watercraft support 118*b*. The first and second watercraft supports 118*a*, 118*b* are substantially similar.

Each support 118*a*, 118*b* includes an arm 120*a*, 120*b*, a leg 122*a*, 122*b*, an arm guide 124*a*, 124*b*, a leg guide 126*a*, 126*b*, an upper link 128*a*, 128*b*, and a lower link 130*a*, 130*b*.

The arms 120*a*, 120*b* are elongate rigid members. Each arm 120*a*, 120*b*, is fixedly mounted to each leg 122*a*, 122*b*, respectively. Each arm 120*a*, 120*b* is also pivotally connected to the upper links 128*a*, 128*b* and lower links 130*a*, 130*b*. Further, each arm guide 124*a*, 124*b* extends away from each arm 120*a*, 120*b*. In some embodiments, each arm 120*a*, 120*b* can include a coating/sleeve/insert 131 that aids in reducing accidental damage to the watercraft 104 while operating the watercraft lift 100. Further, the coating/sleeve/insert 131 also aids in securely storing the watercraft 104 when the watercraft lift 100 is in the raised position. In some embodiments, the arms 120*a*, 120*b*, include channels 132*a*, 132*b* disposed within each arm 120*a*, and 120*b*.

The channels 132*a*, 132*b* are configured to mount a variety of attachments, such as securing features 134 or the coating/sleeve/insert 131, within each channel 132*a*, 132*b*. The securing features 134 are configured to be used to secure the watercraft 104 to the watercraft lift 100, specifically to the arms 120*a*, 120*b* when the watercraft lift 100 is in the raised position. In some embodiments, the channels 132*a*, 132*b* are configured to hold the coating/sleeve/insert 131 to both protect and grip the watercraft 104.

Like the arms 120*a*, 120*b*, the legs 122*a*, 122*b* are elongate rigid members. Each leg 122*a*, 122*b* is fixedly mounted to each arm 120*a*, 120*b*, respectively. Each leg guide 126*a*, 126*b* extends away from each leg 122*a*, 122*b*. Each leg 122*a*, 122*b* can also be lined with the coating or sleeve 131 that aids in reducing accidental damage to the watercraft 104. In some embodiments, like the arms, 120*a*, 120*b*, each leg 122*a*, 122*b* includes channels 136*a*, 136*b* disposed within each leg 122*a*, 122*b* for receiving securing features 134, bumpers, or other attachments.

Figure 14:
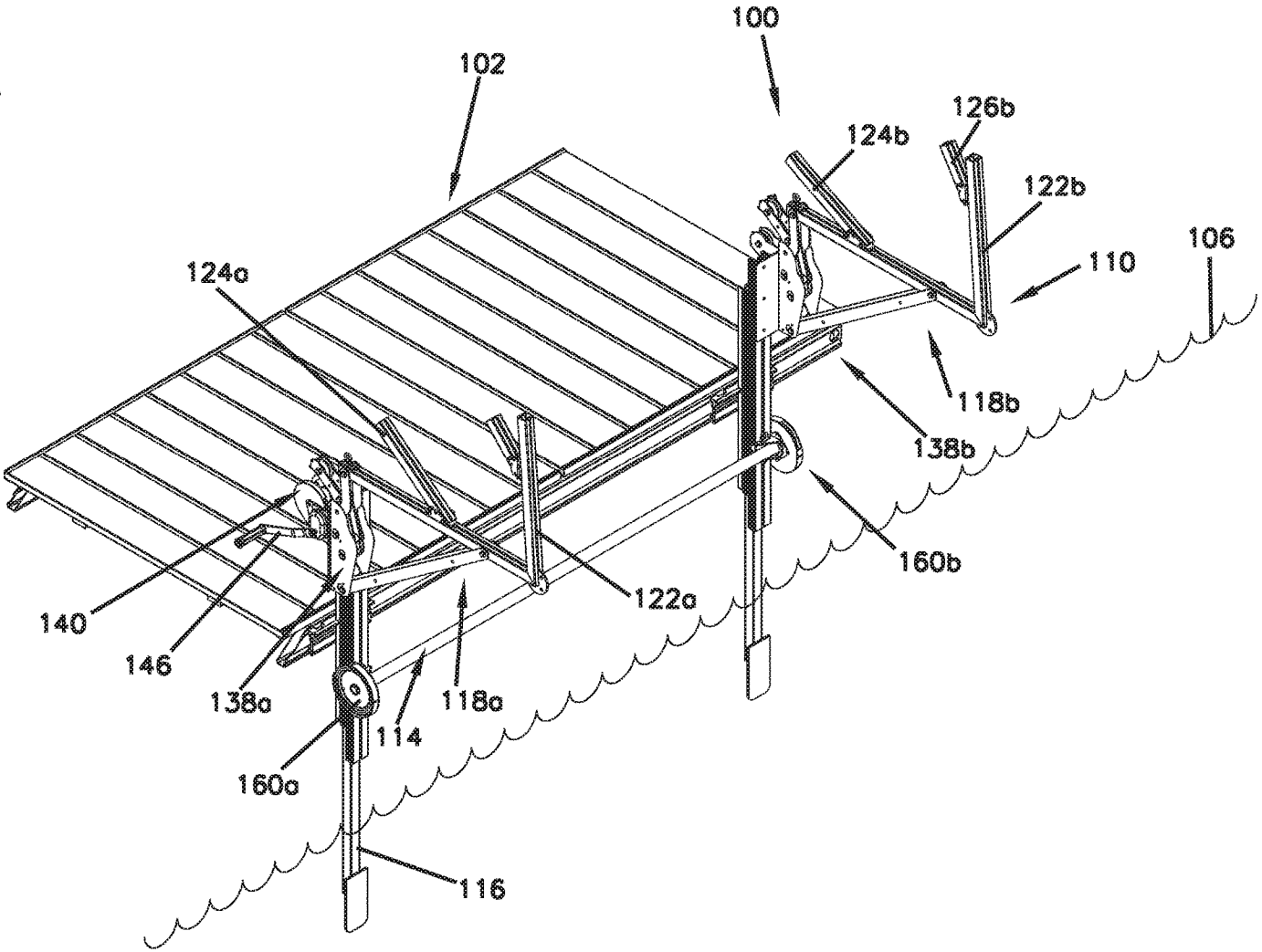
FIG. 14 illustrates a perspective view of the watercraft lift of FIG. 1 in the raised position configured to receive differently sized watercraft, according to one embodiment of the present disclosure.
Figure 15:
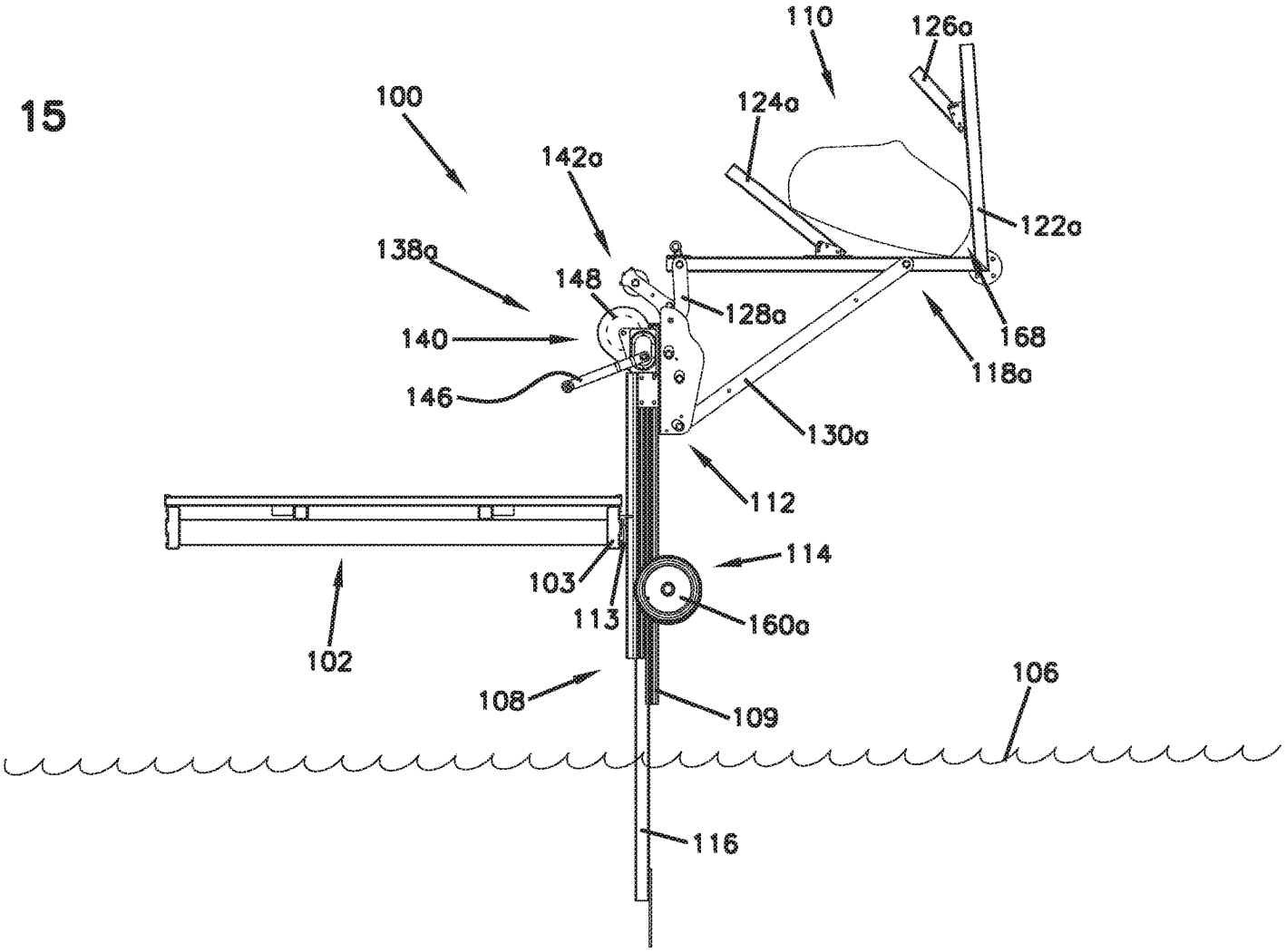
FIG. 15 illustrates a right side view of the watercraft lift of FIG. 14 in the raised position.

The arm guides 124*a*, 124*b* and leg guides 126*a*, 126*b* are elongate rigid members configured to aid in retaining the watercraft 104 on the arms 120*a*, 120*b* and the legs 122*a*, 122*b* when the operator is moving the watercraft lift 100 between the lowered position (see FIG. 1.) and raised position (see FIG. 2). In some embodiments, the arm guides 124*a*, 124*b* and leg guides 126*a*, 126*b* can be adjustably angled with the respect to the arms 120*a*, 120*b* and legs 122*a*, 122*b*. Further, the arm guides 124*a*, 124*b* and leg guides 126*a*, 126*b* can also be adjusted along the length of the arms 120*a*, 120*b*, the legs 122*a*, 122*b* (as shown in FIGS. 14 and 15). This allows the operator to customize the position of the arm guides 124*a*, 124*b* and leg guides 126*a*, 126*b* so as to properly interface with their particular watercraft 104.

The upper links 128*a*, 128*b* and lower links 130*a*, 130*b* are configured to pivotally connect to the arms 120*a*, 102*b* of the supports 118*a*, 118*b* with the pivoting assembly 112. Further, the upper links 128*a*, 128*b* and lower links 130*a*, 130*b* provide addition structural support for the arms 120*a*, 102*b* when moving between the lowered and raised positions.

With continued reference to FIG. 3, the pivoting assembly 112 is attached to the base 108 and to the extension 110. Specifically, the pivoting assembly 112 includes a first support pivoting assembly 138*a*, that corresponds to the first watercraft support 118*a* of the extension 110, and a second support pivoting assembly 138*b*, that corresponds to the second watercraft support 118*b* of the extension 110.

The first support pivoting assembly 138*a* is mounted to the base 108, specifically to the base member 109, and also attached to the first watercraft support 118*a* by way of the upper and lower links 128*a*, 130*a*. The first support pivoting assembly 138*a* includes an extension actuator 140, a pivoting cable guide 142*a*, and a guard 144*a*.

The extension actuator 140 is configured to control the movement of the extension 110 between the lowered and raised positions. In the some embodiments, the extension actuator 140 is configured to be automatically braking, thereby holding the extension 110 in the last operated position when the extension actuator 140 is not being operated. In the depicted embodiments, the extension actuator 140 is a manual winch that uses a hand crank 146 and spool 148 to control cabling which controls the movement of the extension 110. Such cabling and movement will be described herein in further detail with respect to FIGS. 4-12. In some embodiments, the extension actuator 140 is a powered actuator using an electric motor controllable by a switch.

The pivoting cable guide 142*a* is configured to provide a guide for cabling traveling from the extension actuator 140 to the arm 120*a* of the first watercraft support 118*a*. The pivoting cable guide 142*a* includes a circular guide 141*a* that is configured to receive a line of cabling. The pivoting cable guide 142*a* is attached to the upper link 128*a* by a pivot guide linkage 150*a*. The pivoting cable guide 142*a* pivots about a first point 152*a* and moves when the upper link 128*a* pivots about a second point 154*a*. The pivoting cable guide 142*a* moves in a direction toward the water 106 when the extension 110 is moving from the raised position to the lowered position. The pivoting cable guide 142*a* pivots in a direction away from the water 106 when the extension 110 is moving from the lowered position to the raised position. The pivoting cable guide 142*a* aids in providing a smooth, obstruction free route for cabling traveling from the extension actuator 140 to the first watercraft support 118*a*.

The guard 144*a* covers the first pivot point 152*a*, second pivot point 154*a*, and a third pivot point 156*a* of which the lower link 130*a* pivots about. The guard 144*a* is configured to help prevent unwanted objects from coming in contact with the portions of the first support 118*a* and becoming pinched near the first support pivoting assembly 138*a*.

FIG. 3 also shows a perspective view of the second support pivoting assembly 138*b* mounted to the base 108, specifically to the base member 109, and also attached to the second watercraft support 118*b* by way of the upper and lower links 128*b*, 130*b*. Like the first support pivoting assembly 138*a*, the second support pivoting assembly 138*b* includes a pivoting cable guide 142*b*. The pivoting cable guide 142*b* includes a circular guide 141*b* that is configured to receive a line of cabling. The pivoting cable guide 142*b* is attached to the upper link 128*b* by a pivot guide linkage 150*b*. The second support pivoting assembly 138*b* shares many substantially similar parts with the first support pivoting assembly 138*a*. For clarity and conciseness, such shared parts are shown in the drawings on the second support pivoting assembly 138*b* with the reference number used to described the parts of the first support pivoting assembly 138*a*, described above, followed by a "b" notation. However, instead of the extension actuator 140 of the first support pivoting assembly 138*a*, the second support pivoting assembly 138*b* includes a fixed cable guide 158. The fixed cable guide 158 is configured provide a smooth, obstruction free route for cabling traveling from the second watercraft support 118*b* to the linkage 114.

The linkage 114 is configured to transfer the moving energy from the extension actuator 140, which is mounted to the first support pivoting assembly 138*a*, to the second support pivoting assembly 138*b* that acts to rotate the second watercraft support 118*b*. The linkage 114 therefore allows the first and second watercraft supports 118*a*, 118*b* to move in unison. The linkage 114 includes a first spool 160*a*, a second spool 160*b*, a shaft 162, and optionally a shaft housing 164. The linkage 114 is mounted to the base 108.

The spools 160*a*, 160*b* are configured to receive cabling and configured to rotate to either release cabling or take up cabling. In some embodiments, the spools 160*a*, 160*b* may include covers 166 that are configured to guard the spools 160*a*, 160*b* from objects coming into inadvertent contact with the spools 160*a*, 160*b*.

In some embodiments, the shaft 162 is positioned within the shaft housing 164 and fixed to the first spool 160*a* and the second spool 160*b*. The shaft 162 is configured to be rotatable about a longitudinal shaft axis. Further, the shaft 162 is rotatable in response to the rotation of the first and second spools 160*a*, 160*b*. Specifically, when the first spool 160*a* is rotated about the longitudinal shaft axis, the shaft 162 transfers the rotation of the first spool 160*a* to the second spool 160*b*. In some embodiments, the shaft 162 is separable and telescoping so as to have an adjustable length.

Figure 4:
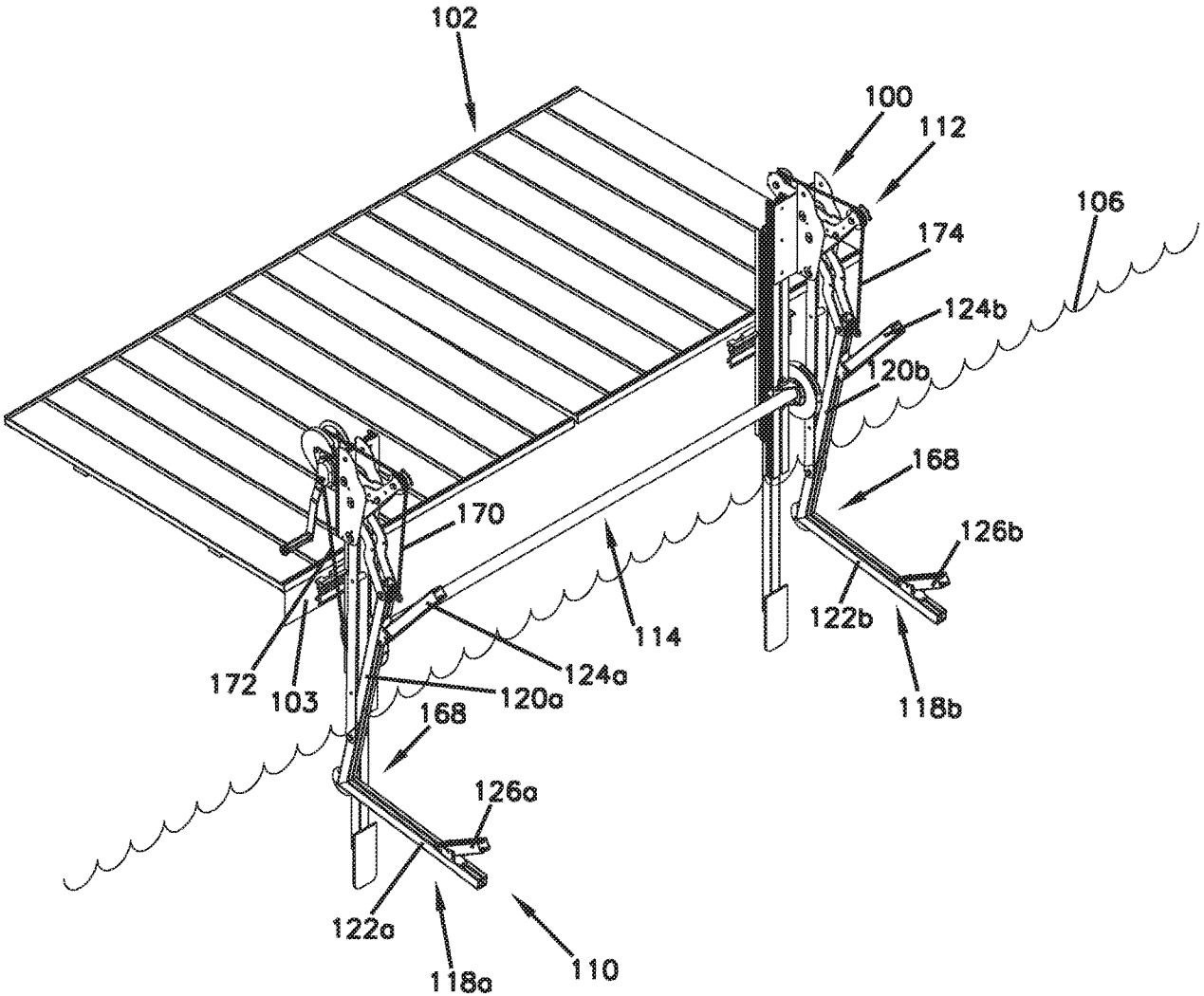
FIG. 4 illustrates a perspective view of the watercraft lift of FIG. 1 in the lowered position.
Figure 5:
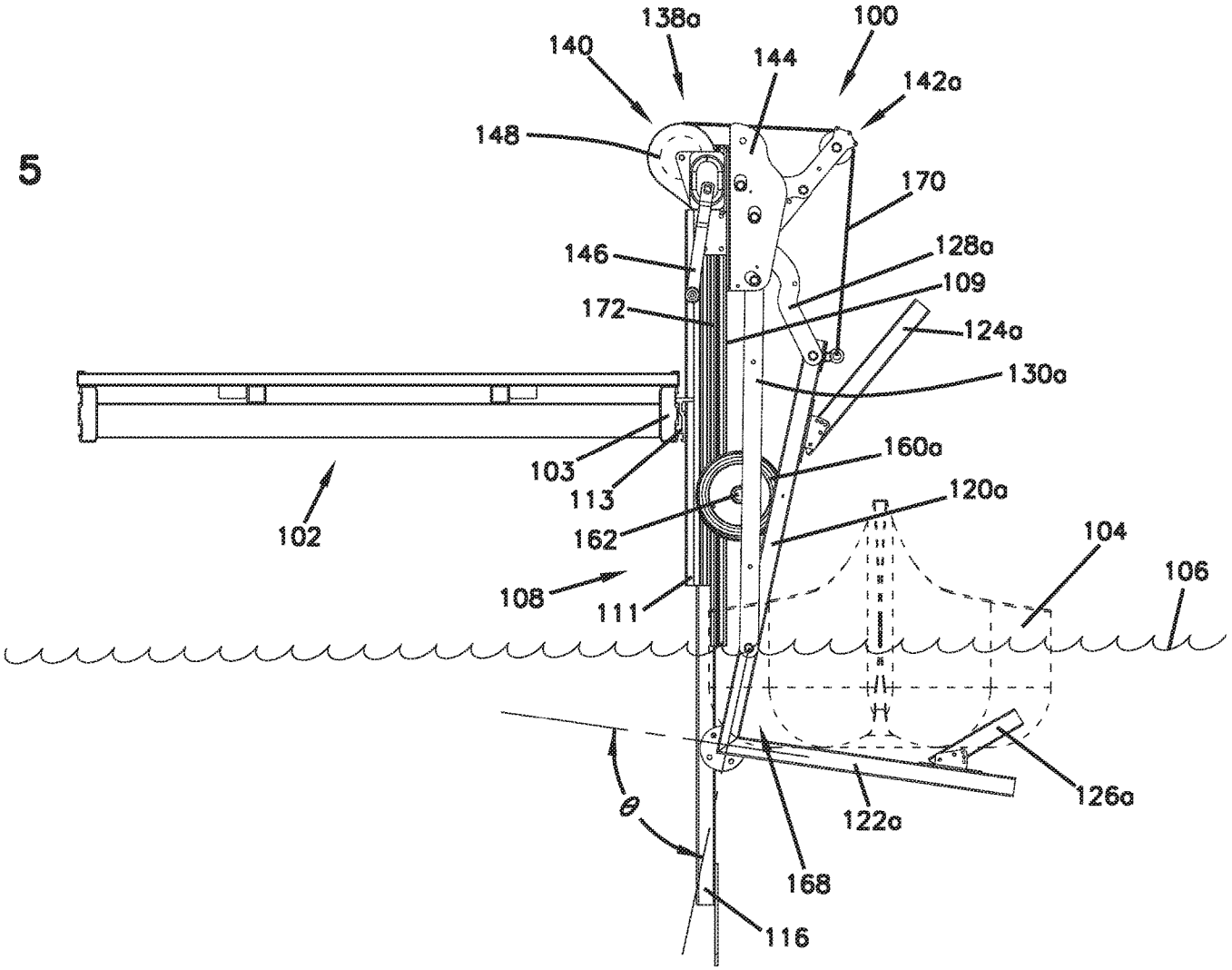
FIG. 5 illustrates a right side view of the watercraft lift of FIG. 1 in the lowered position.
Figure 6:
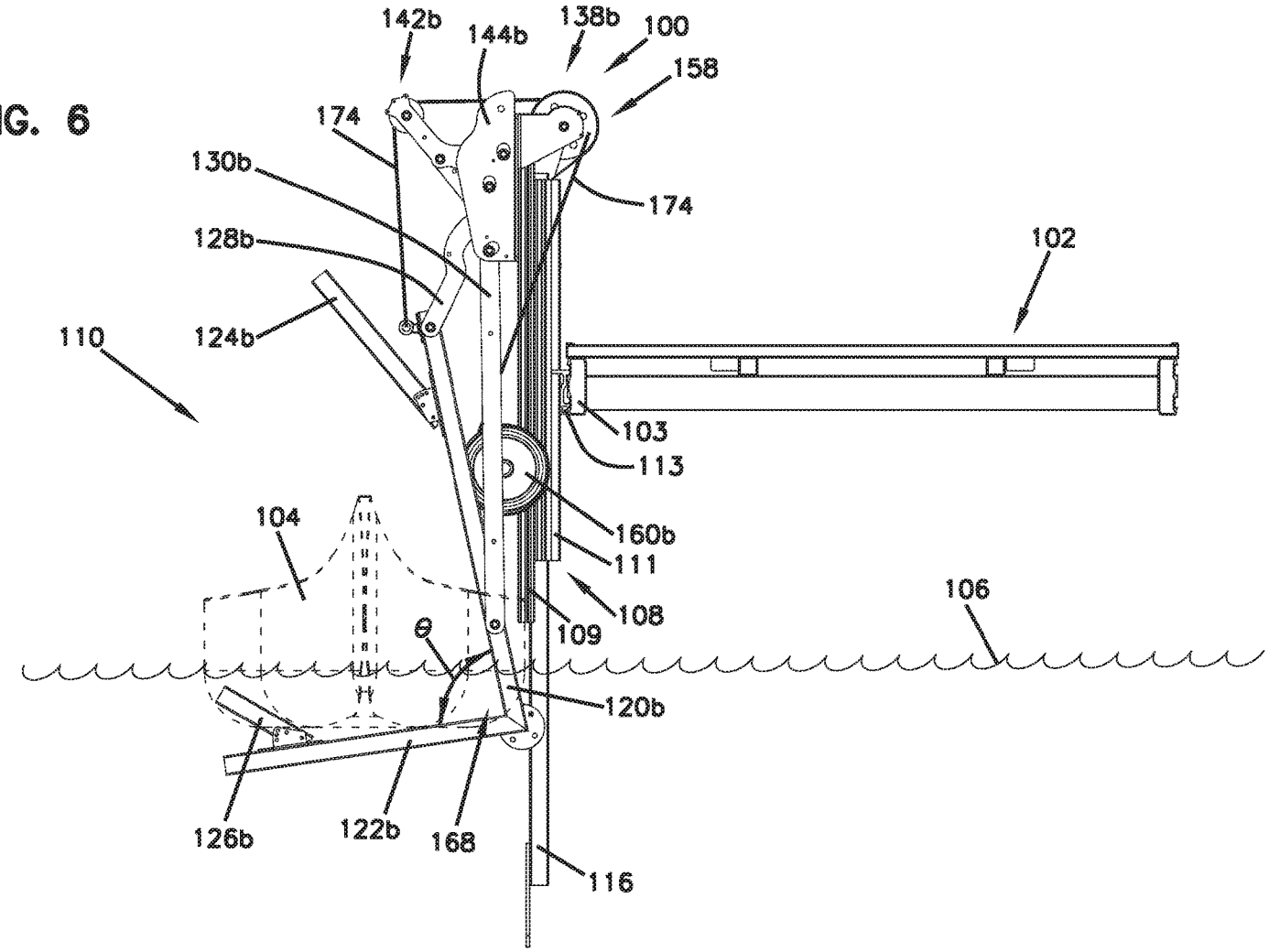
FIG. 6 illustrates a left side view of the watercraft lift of FIG. 1 in the lowered position.

FIG. 4 shows a perspective view of the watercraft lift 100 in the lowered position, without the watercraft 104. FIG. 5 shows a right side view of the watercraft lift 100 in the lowered position. FIG. 6 shows a left side view of the watercraft lift 100 in the lowered position.

When the watercraft lift 100 is in the lowered position, the arms 120*a*, 120*b* extend generally downward toward the water 106. In some embodiments, the arms 120*a*, 120*b* are generally perpendicularly fixed to the legs 122*a*, 122*b*. In some embodiments, the arms 120*a*, 120*b*, form an angle θ with the legs 122*a*, 122*b* between about 75 degrees and about 100 degrees. The arms 120*a*/120*b*, legs 122*a*/122*b*, arm guides 124*a*/124*b*, and leg guides 126*a*/126*b* define a watercraft pocket 168. The watercraft pocket is configured to help cradle and scoop the watercraft 104 from the water 106.

As shown, when in the lowered position, the legs 122*a*, 122*b* and leg guides 126*a*, 126*b* sit just below the surface of the water 106 so as to allow the operator to easily position the watercraft 104 in the watercraft pocket 168.

Figure 7:
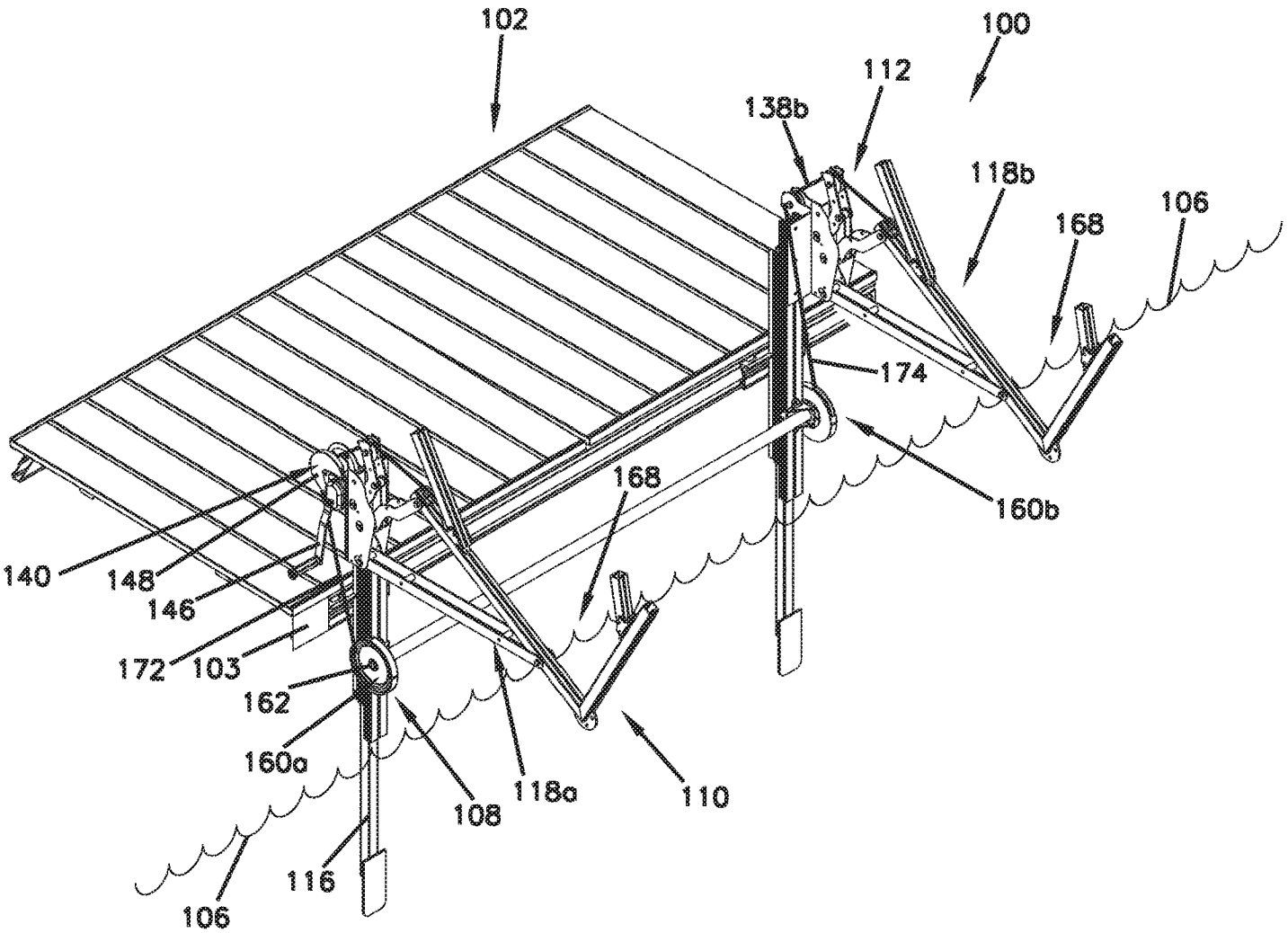
FIG. 7 illustrates a perspective view of the watercraft lift of FIG. 1 between the raised position and the lowered position.

Also, as shown in FIGS. 5-7, cabling is used to raise and lower the extension 110. Specifically, a first cable 170 is connected to the spool 148 of the extension actuator 140 and to the arm 120*a* of the first watercraft support 118*a*. A second cable 172 is connected to the spool 148 of the extension actuator 140 and to the first spool 160*a* of the linkage 114.

A third cable 174 is connected to the second spool 160*b* of the linkage 114 and to the arm 120*b* of the second watercraft support 118*b*.

In the depicted embodiment, when raising the watercraft lift 100 after the watercraft 104 is positioned in the watercraft pocket 168, the operator rotates the hand crank 146 of the extension actuator 140. Upon such rotation of the hand crank 146, the first and second cables 170, 172 are wound around the spool 148. The first cable 170 is shortened while the second cable maintains the same length. Excess cabling of the second cable 172 previously stored on the first spool 160*a* of the linkage 114 is transferred to the spool 148 of the extension actuator 140.

As the excess cabling of the second cable 172 is transferred to the spool 148, the first spool 160*a* of the linkage 114 is rotated. The rotation of the first spool 160*a* causes rotation of the shaft 162, which causes rotation of the second spool 160*b*. As the second spool 160*b* rotates, the third cable 174 is shortened and excess cabling is wound around the second spool 160*b* of the linkage 114.

As the first cable 170 and the third cable 174 are shortened, the first and second watercraft supports 118*a*, 118*b* begin to rise from the water 106.

Figure 8:
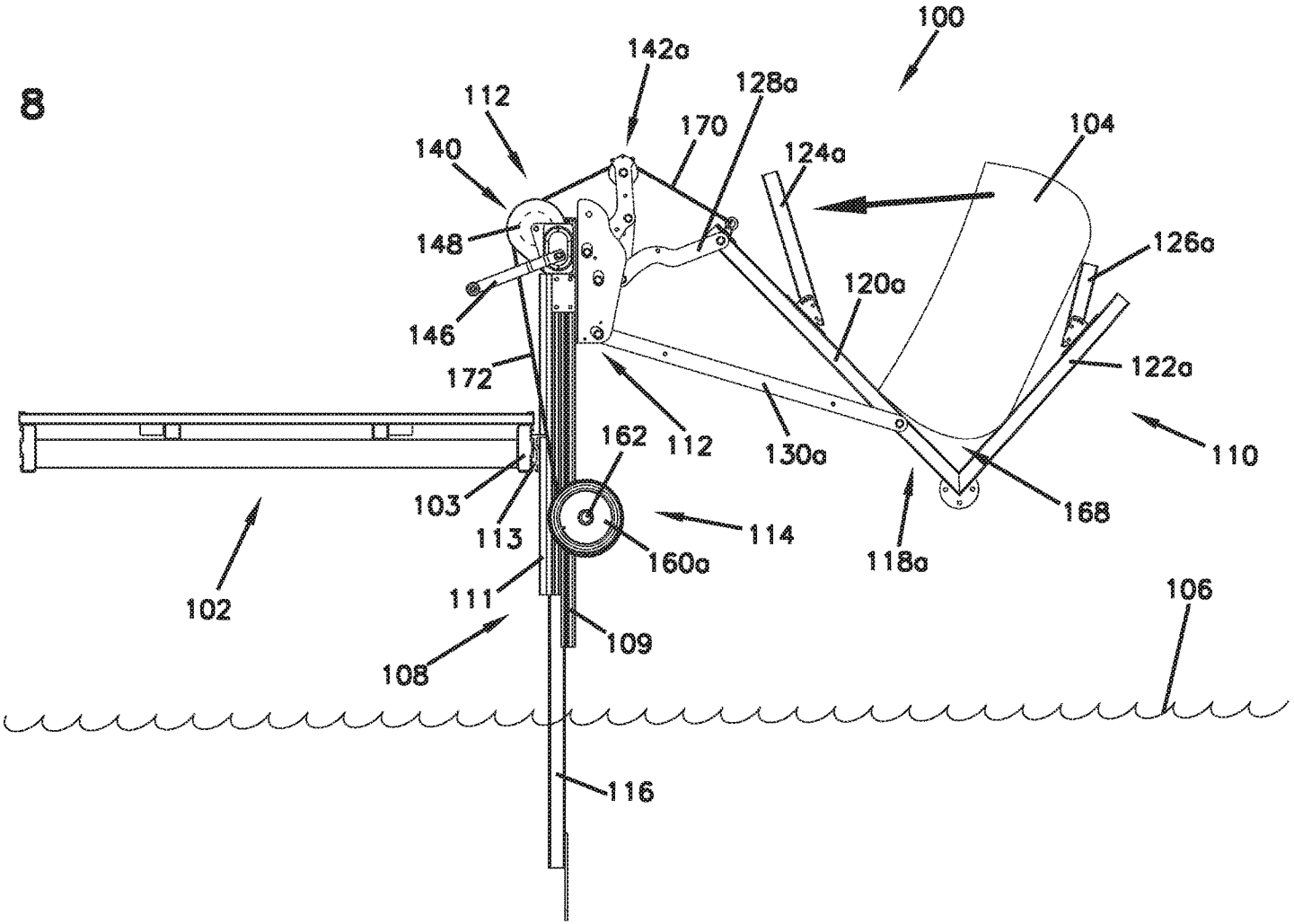
FIG. 8 illustrates a right side view of the watercraft lift of FIG. 1 between the raised position and the lowered position.
Figure 9:
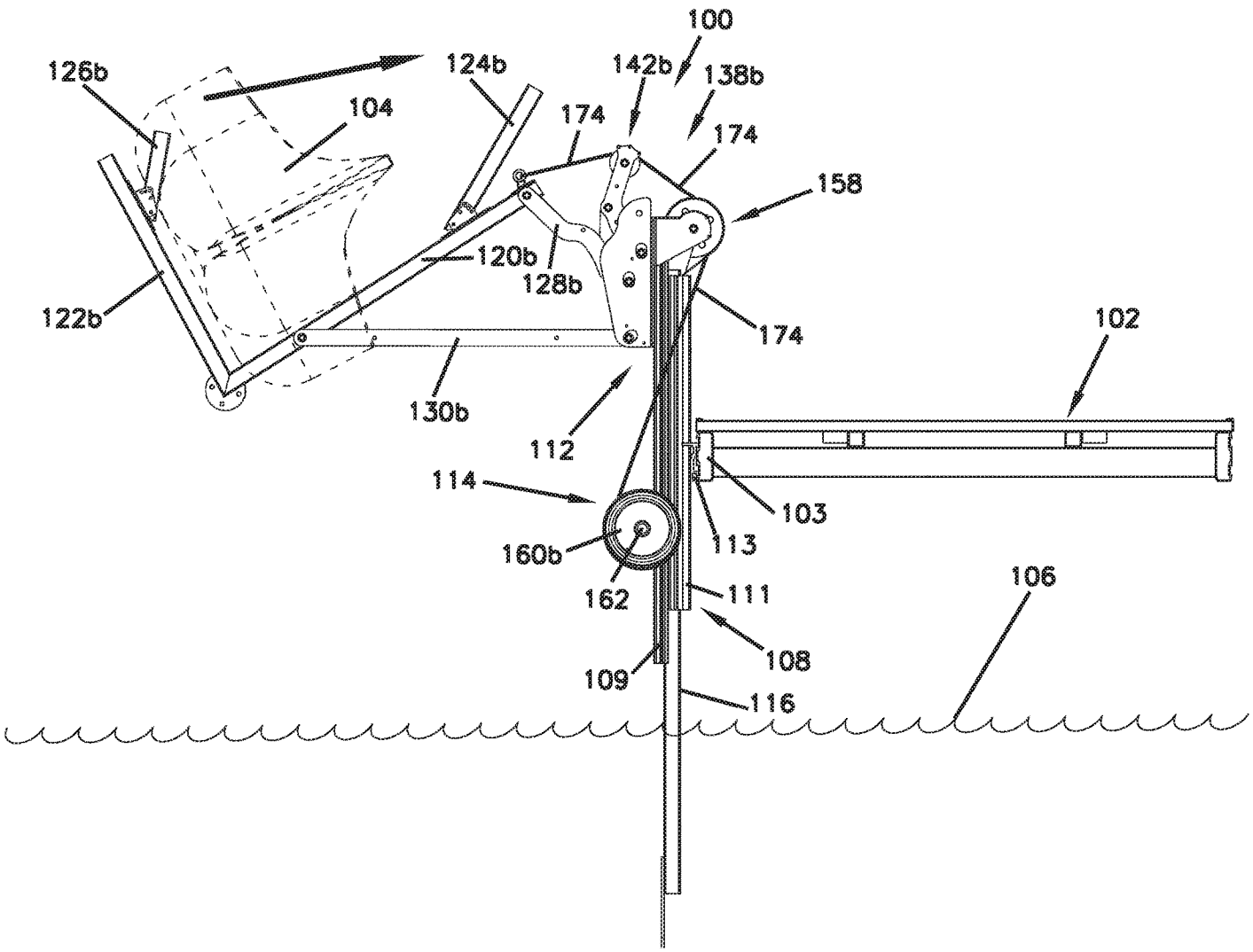
FIG. 9 illustrates a left side view of the watercraft lift of FIG. 1 between the raised position and the lowered position.

FIG. 7 shows a perspective view of the watercraft lift 100 between the lowered position and the raised position, without the watercraft 104. FIG. 8 shows a right side view of the watercraft lift 100 between the lowered position and the raised position with the watercraft 104. FIG. 9 shows a left side view of the watercraft lift 100 between the lowered position and the raised position with the watercraft 104.

As the watercraft lift 100, specifically the extension 110, begins to rise from the water 106, the upper links 128*a*, 128*b*, and lower links 130*a*, 130*b* begin to pivot the first and second watercraft supports 118*a*, 118*b* about the pivoting assembly 112.

FIGS. 8 and 9 show side views of the watercraft lift 100 and the position of the watercraft 104 when the watercraft lift 100 is between the lowered and raised positions. As shown, the watercraft 104 is positioned within the watercraft pocket 168 and begins to invert and the pivoting assembly 112 as the extension 110 is rotated closer to the raised position, as indicated by the arrows in the drawings. If the watercraft 104 fully inverts, the arm guides 124*a*, 124*b* are configured to catch the watercraft 104 as it moves to the stored position.

As the hand crank 146 is further rotated, the first and third cables 170, 174 are shortened further still until the watercraft lift 100 is in the raised position.

Figure 10:
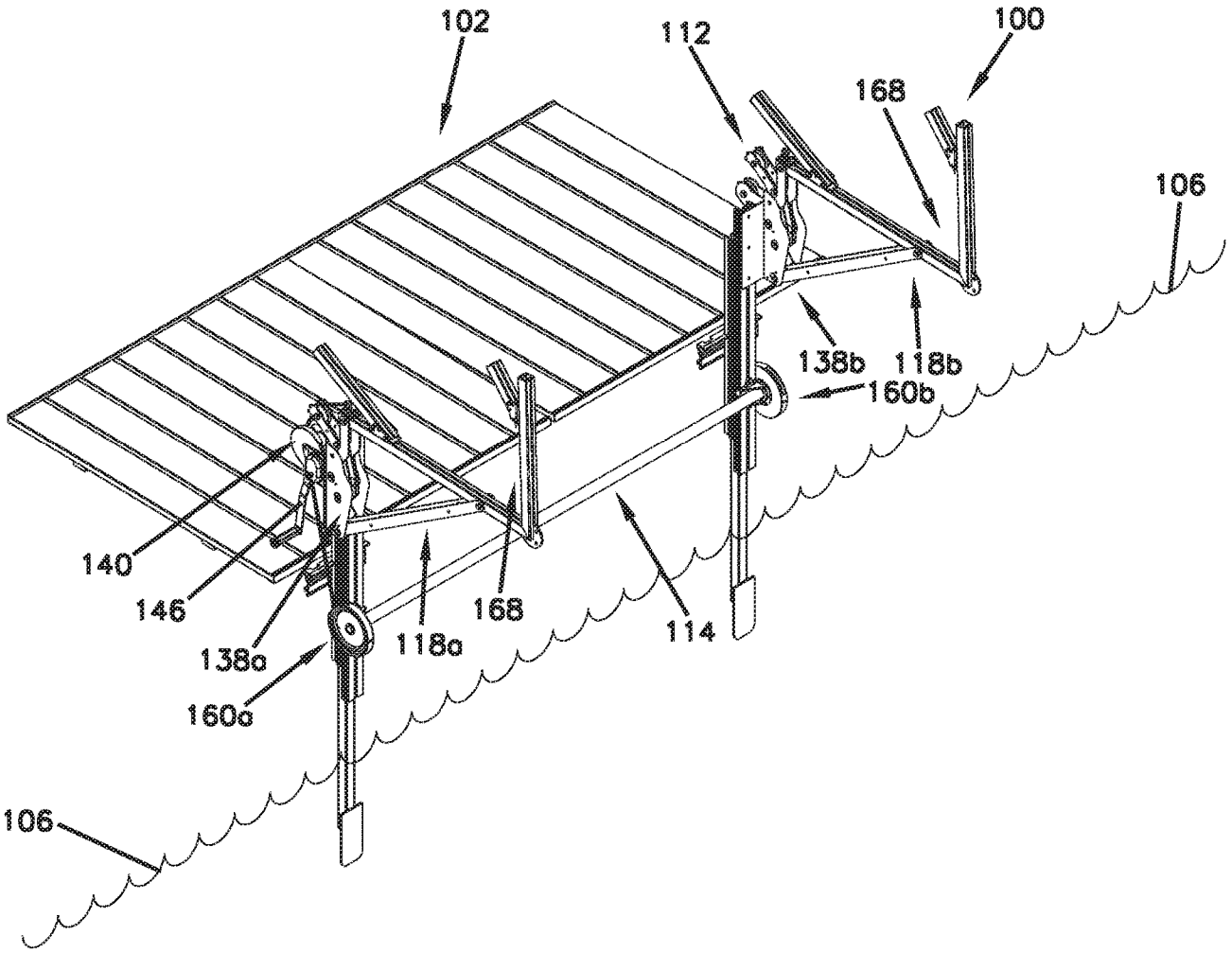
FIG. 10 illustrates a perspective view of the watercraft lift of FIG. 1 in the raised position.
Figure 11:
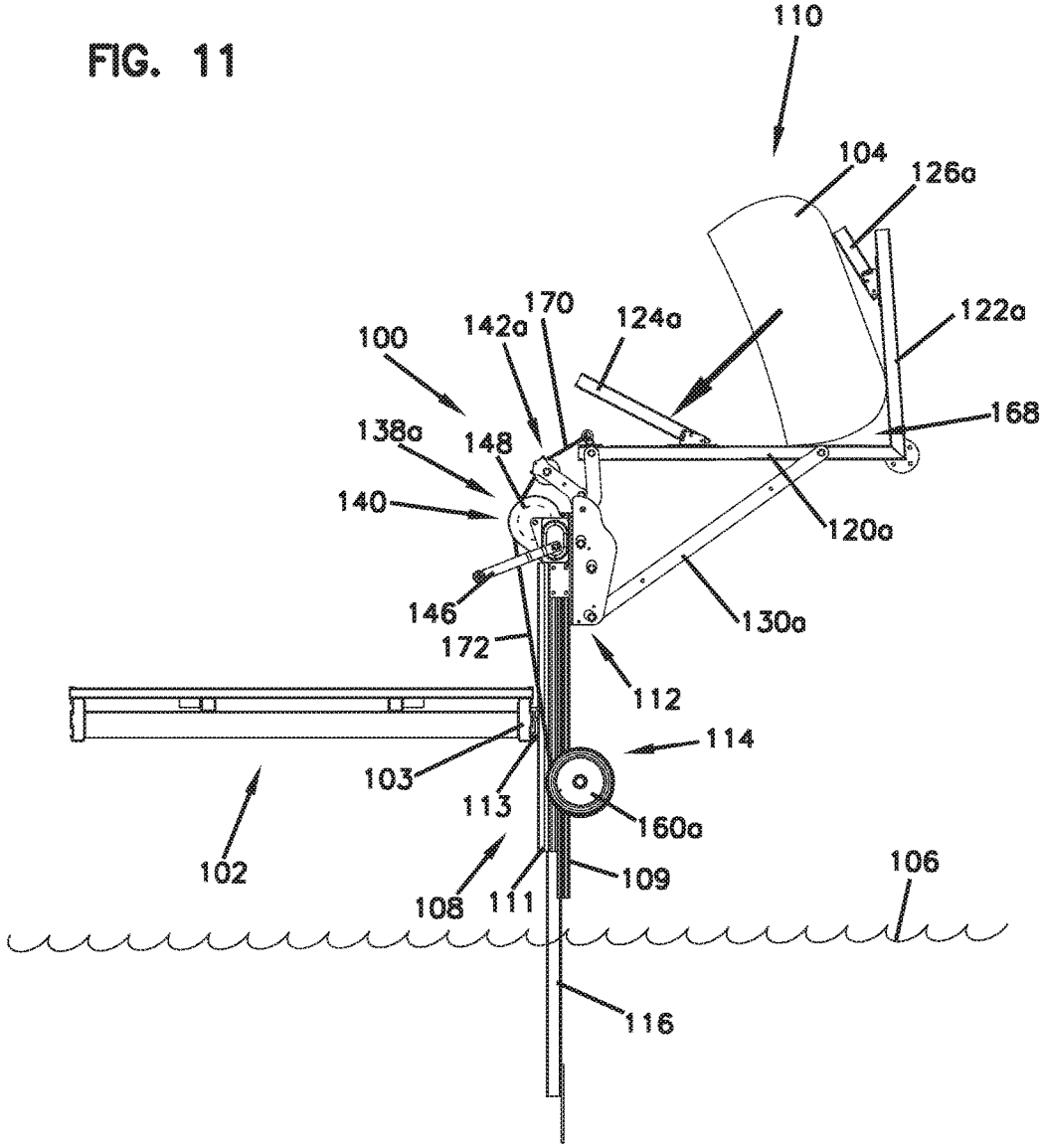
FIG. 11 illustrates a right side view of the watercraft lift of FIG. 1 in the raised position.
Figure 12:
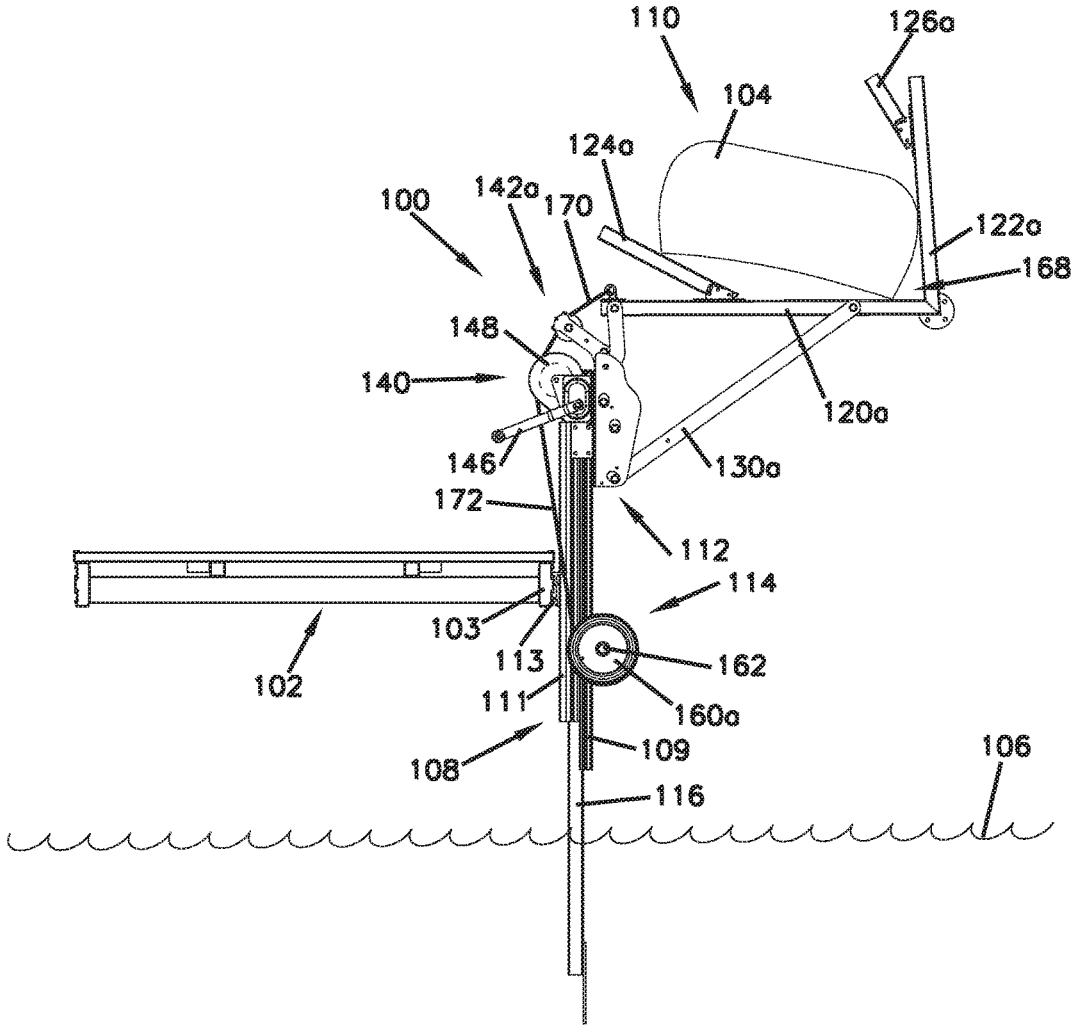
FIG. 12 illustrates a right side view of the watercraft lift of FIG. 1 in the raised position with a watercraft in a secured position.
Figure 13:
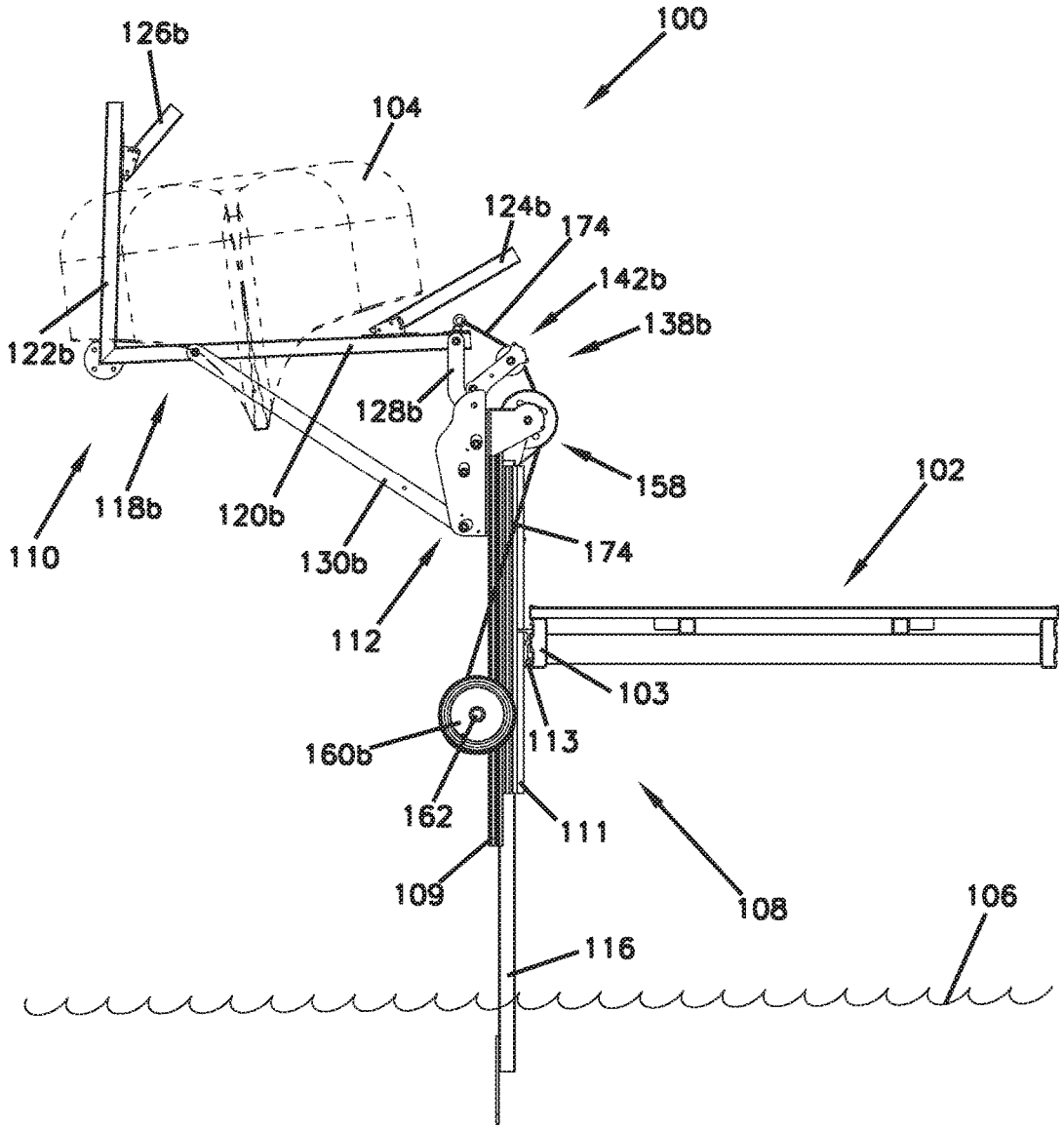
FIG. 13 illustrates a left side view of the watercraft lift of FIG. 1 in the raised position.

FIG. 10 shows a perspective view of the watercraft lift 100 in the raised position, without the watercraft 104. FIG. 11 shows a right side view of the watercraft lift 100 in the raised position and the watercraft 104 in a position directly before the watercraft 104 is in a secured position. FIG. 12 shows a right side view of the watercraft lift 100 in the raised position with the watercraft 104 lowered to a securing position. FIG. 13 shows a left side view of the watercraft lift 100 in the raised position.

When in the raised position, the watercraft lift 100 is configured to store the watercraft 104 in a secured position above the water and offset from the structure 102. In some embodiments, the watercraft 104 can be secured to the extension 110 so as to prevent inadvertent removal of the watercraft 104. The watercraft 104 can be secured, for example, by using straps or other similar devices attached to the extension 110. When moving into the secured position, the position of the guides 124*a*, 124*b* and 126*a*, 126*b* are configured to urge the watercraft 104 to an inverted position, shown in FIG. 11 by an arrow. As shown in FIGS. 12 and 13, the watercraft 104 is stored in an inverted position so as to prevent unwanted material (e.g., leaves, water, etc.) from collecting within the watercraft 104 as it is stored.

In the depicted embodiments, the extension actuator 140 is auto braking so as to maintain the extension 110 at its last operated position. In some embodiments, the extension actuator 140 includes a manual lock so as to allow the user to lock the watercraft lift in a particular position, specifically the raised position.

FIGS. 14 and 15 show the arm guides 124*a*, 124*b* and leg guides 126*a*, 126*b* in different positions along the arms 120*a*, 120*b* and legs 122*a*, 122*b*. Such adjustment can be made to hold a watercraft 107 of a different shape or size.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

I claim:

1. A watercraft lift comprising:

a base configured to attach to, and be horizontally offset from, a fixed surface, the base including a pair of telescoping support legs that are extendable to contact a water floor to vertically support the watercraft lift;

an extension extending from the base, the extension including a pair of arms and a pair of legs, each leg attached to and extending away from each arm, wherein the extension is rotatable about the base between a lowered position and a raised position, wherein; when in the lowered position, the extension is configured to receive a watercraft in an upright position, wherein, when in the raised position, the extension is configured to store the watercraft in a position horizontally offset from the fixed surface, and wherein, when moving to the raised position, the extension at least partially moves the watercraft upside down; and an extension actuator mounted to the base and connected to at least one of the arms of the extension, the extension actuator being configured to move the extension between the lowered position and the raised position.

2. The watercraft lift of claim 1, wherein the extension actuator is automatically locking, wherein the extension actuator locks the extension in a position when the extension actuator is not being operated.

3. The watercraft lift of claim 1, wherein the extension actuator includes a hand crank.

4. The watercraft lift of claim 1, wherein the extension actuator is operable by a motor.

5. The watercraft lift of claim 1, further comprising a linkage connected to the extension, wherein the linkage moves the pair of legs and pair of arms in unison when the extension is moved between the lowered position and the raised position.

6. The watercraft lift of claim 1, wherein the watercraft is secured in an inverted position to the extension when the extension is in the raised position.

7. The watercraft lift of claim 1, wherein the base includes a pair of first and second base members that are attached to the fixed surface by way of mounting features.

8. The watercraft lift of claim 7, wherein each of the first base members are adjustable along a length of each of the second base members so as to allow the base to be adjustable in a vertical direction.

9. The watercraft lift of claim 7, wherein the mounting features are configured to mount within a channel.

10. The watercraft lift of claim 1, wherein the extension actuator is connected to one arm via a first cable, and wherein the extension actuator controls movement of the opposite arm via a second cable.

11. A watercraft lift comprising:

a base configured to attach to a fixed surface, the base including a pair of telescoping support legs that are extendable to contact a water floor to vertically support the watercraft lift the base including a pair of base members that are attachable to the fixed surface by way of mounting features, wherein each of the base members is adjustable so as to allow the base to be adjustable in a vertical direction with respect to the fixed surface;

an extension including a first support extending from the base and a second support extending from the base, each of the first and second supports defining a watercraft pocket configured to receive a watercraft;

an extension actuator mounted to the base, the extension actuator being in communication with the first support, the extension actuator configured to move the first support between a lowered position and a raised position, wherein, when in the lowered position, the extension is configured to receive a watercraft in an upright position, wherein, when in the raised position, the extension is configured to store the watercraft in a position horizontally offset from the fixed surface; and, and wherein, when moving to the raised position, the watercraft pockets of the first and second supports are at least partially moved upside down; and a linkage attached to the first support and the second support, the linkage being configured to move the second support in unison with the first support when the extension actuator moves the first support between the lowered position and the raised position, wherein the linkage includes:

a shaft;

first and second spools mounted to the shaft, wherein the first spool is mounted adjacent the first support and the second spool is mounted adjacent the second support, wherein the first spool is rotatable by the extension actuator when moving the first support between the lowered and raised positions, wherein the first spool rotates the shaft, and wherein the shaft rotates the second spool when the shaft is rotated by the first spool.

12. The watercraft lift of claim 11, wherein the first and second supports each include an arm and a leg, wherein each leg is attached to each arm of each support, and wherein each leg is perpendicular to each arm of each support.

13. The watercraft lift of claim 11, wherein the watercraft is secured to the first and second supports when the supports are in the raised position.

14. The watercraft lift of claim 11, wherein the extension actuator is automatically locking, wherein the extension actuator locks the first support in a position when the extension actuator is not being operated.

15. The watercraft lift of claim 11, wherein the extension actuator includes a hand crank.

16. The watercraft lift of claim 11, wherein the extension actuator is operable by a motor.

17. The watercraft lift of claim 11, wherein the extension actuator is connected to the first support and to the linkage via a first cable, and wherein the linkage is connected to the second support by a second cable.

18. The watercraft lift of claim 11, wherein the first support of the extension is pivotally attached to the base at a first location and the second support is pivotally attached to the base at a second location, wherein the linkage is attached to the first support at a third location and attached to the second support at a fourth location, the third and fourth locations being different from the first and second locations.

19. A watercraft lift comprising:

a base configured to attach to, and be horizontally offset from, a fixed surface, the base including a pair of telescoping support legs that are extendable to contact a water floor to vertically support the watercraft lift;

an extension extending from the base, the extension including a pair of arms and a pair of legs, each leg attached to and extending away from each arm;

wherein the extension is rotatable about the base between a lowered position and a raised position, wherein, when in the lowered position, the extension is configured to receive a watercraft, wherein, when in the raised position, the extension is configured to store the watercraft in a position horizontally offset from the fixed surface, and wherein, when moving to the raised position, the extension at least partially moves the watercraft upside down.

* * * * *